United States Patent [19]

Sano et al.

[11] Patent Number: 4,707,292

[45] Date of Patent: Nov. 17, 1987

[54] DETERGENT COMPOSITION

[75] Inventors: Tomohiko Sano, Funabashi; Noriyoshi Fujisawa, Sakura; Masataka Fukuda, Funabashi; Tsuyoshi Suganuma, Ichikawa, all of Japan

[73] Assignee: Kao Corporation, Tokyo, Japan

[21] Appl. No.: 842,334

[22] Filed: Mar. 21, 1986

[30] Foreign Application Priority Data

Apr. 3, 1985 [JP] Japan ..... 60-70581

[51] Int. Cl.[4] ..... C11D 3/06

[52] U.S. Cl. ..... 252/174.16; 252/89.1; 252/DIG. 17

[58] Field of Search ..... 252/89.1, 174.16, DIG. 17

[56] References Cited

U.S. PATENT DOCUMENTS

| | | | |
|---|---|---|---|
| 3,562,168 | 2/1971 | Westmore | 252/174.16 |
| 3,655,569 | 4/1972 | Hellsten et al. | 252/95 |
| 3,770,855 | 11/1973 | Benson et al. | 252/174.16 |
| 3,951,826 | 4/1976 | Rasmussen | 252/174.16 |
| 3,956,198 | 5/1976 | Bauer | 252/DIG. 17 |
| 4,175,051 | 11/1979 | Imamura et al. | 252/DIG. 17 |
| 4,601,844 | 7/1986 | Cilley | 252/174.16 |

*Primary Examiner*—Paul Lieberman
*Assistant Examiner*—Willie J. Thompson
*Attorney, Agent, or Firm*—Flynn, Thiel, Boutell & Tanis

[57] ABSTRACT

A detergent composition comprises 10 parts by weight of a phosphoric acid ester of the formula (I) or (II):

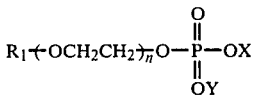

(I)

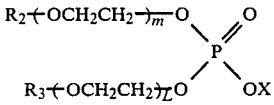

(II)

in which R1, R2 and R3 each are a saturted or unsaturated hydrocarbon group having 8 to 18 carbon atoms, X and Y each are hydrogen, an alkali metal, ammonium or an alkanolamine having 2 to 3 carbon atoms and n, m and L each are zero or an integer of 1 to 10, and (B) 0.05 to 10 parts by weight of an insoluble metal salt of a surface active agent.

11 Claims, No Drawings

DETERGENT COMPOSITION

The invention relates to a detergent composition and provides the composition with an improved mildness to the skin and the hair and further an improved foaming property.

STATEMENT OF PRIOR ART

Recently, the safety requirement for cleansers has become severe, and research for developing novel surface active agents having an enhanced safety has become vigorous. Furthermore, of the surface active agents heretofore used, those having a high safety are reconsidered even though their cleansing effect is low, and studies are made to improve the cleansing effect by combining them with other bases.

Of many known surface active agents, anionic surface active agents consisting of phosphoric acid ester salts, such as salts of lauryl phosphate and myristyl phosphate, are mild to the skin and are excellent in the feel during use and therefore, they are used as detergent base of solid detergents, shampoos, dental creams, cleansing creams, body shampoos and the like.

When these cleanser compositions are used for parts contaminated with oily dirts, such as made-up faces and feet and hands after vigorous exercise, the cleansing power is sufficient but the bubbling property is insufficient, and especially in case of cleanser compositions which are used in the state bubbled by a towel or the like, such as solid detergents or body shampoos, this weak bubbling power is a fatal defect because the weak bubbling power results directly in reduction of the quality.

As pointed out hereinbefore, a cleanser composition comprising a surface active agent of the phosphoric acid ester type is excellent in the cleansing power, but it is defective in that the bubbling property is relatively poor. Accordingly, it is eagerly desired to improve the bubbling property of a cleanser composition comprising a surface active agent of the phosphoric acid ester type while utilizing the characteristics of this surface active agent. However, a cleanser composition meeting this desire has not been developed.

SUMMARY OF THE INVENTION

In order to provide a technical improvement in the above shown state of arts, a research has been made to improve a foaming property, or a bubbling force, of a phosphoric acid ester salt which is excellent in the safety and mild to the skin, and as a result, it has been found that when (A) a phosphoric acid ester salt having a specific counter ion is combined with (B) an insoluble metal salt of a surface active agent, the bubbling property, the bubble creaminess and the finish feel are improved, and that this improving effect is enhanced if a super-fatting agent (C) is used in combination with the components (A) and (B) and this effect is especially excellent when the concentration of the insoluble metal salt of the surface active agent is low. We have now completed the present invention based on these findings.

The phosphoric acid ester type surface active agent (A) to use as one active component of the detergent composition, called also as a cleanser composition, of the invention is defined by the following general formula (I) or (II):

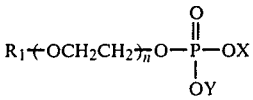

(I)

or

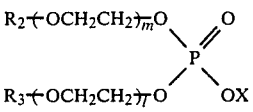

(II)

wherein $R_1$, $R_2$ and $R_3$ stand for a saturated or unsaturated hydrocarbon group having 8 to 18 carbon atoms, X and Y stand for a hydrogen atom, an alkali metal, ammonium and an alkanolamine having 2 or 3 carbon atoms, and l, m and n stand for an integer of from 0 to 10.

A detergent composition of the invention, in other words, comprises 10 parts by weight of the phosphoric acid ester of the formula (I) or (II) and (B) 0.05 to 10 parts by weight of an insoluble metal salt of a surface active agent.

The invention provides another detergent composition comprising 10 parts by weight of (A) said phosphoric acid ester, 0.001 to 10 parts by weight of (B) said insoluble metal salt of a surface active agent and 0.01 to 10 parts by weight of (C) a super-fatting agent.

The phosphoric acid ester may preferably comprise one having the formula (I) and up to 50 percent by weight, based on the total weight of (A), of one having the formula (II).

The invention moreover provides an aqueous solution of the composition, adjusted so as to have a pH of 5.5 to 8.5 when it has a concentration of 5 percent by weight.

The composition of the invention may be in the form of solid, liquid, powder, granules or paste.

The saturated or unsaturated hydrocarbon group may be linear, branched or cyclic, and the hydrocarbon group may be composed of a single hydrocarbon group or may comprise at least two hydrocarbon groups. Alkyl groups having 10 to 14 carbon atoms are especially preferred as $R_1$, $R_2$ and $R_3$. Sodium is preferred as the counter ions X and Y when the composition is used as a solid cleanser, and potassium or an alkanolamine is preferred as the counter ions X and Y when the composition is used as a liquid cleanser.

As preferred examples of the phosphoric acid ester salt, there can be mentioned sodium monolauryl phosphate, sodium dilauryl phosphate, potassium monolauryl phosphate, potassium dilauryl phosphate, diethanolamine monolauryl phosphate, diethanolamine dilauryl phosphate, triethanolamine monolauryl phosphate, triethanolamine dilauryl phosphate, sodium monomyristyl phosphate, sodium dimyristyl phosphate, potassium monomyristyl phosphate, potassium dimyristyl phosphate, triethanolamine monomyristyl phosphate, triethanolamine dimyristyl phosphate, sodium monooleyl phosphate, sodium dioleyl phosphate, potassium monooleyl phosphate, potassium dioleyl phosphate, potassium monocetyl phosphate, triethanolamine monocetyl phosphate, potassium monostearyl phosphate and triethanolamine monostearyl phosphate.

In the present invention, the phosphoric acid ester salt (A) may be a single compound represented by the formula (I) or (II) or may be a mixture of two or more of compounds represented by the formulae (I) and (II). A mixture comprising a compound represented by the formula (I) and a compound represented by the formula (II) at a weight ratio of from 100/0 to 50/50 is especially preferred. It is preferred that the phosphoric acid ester salt (A) be incorporated in the cleanser composition in an amount of 5 to 95% by weight (all of "%" given hereinafter are by weight), especially 10 to 90%.

As preferred examples of the insoluble salt of the surface active agent used as the component (B) in the present invention, there can be mentioned an insoluble metal salt of a higher fatty acid having 8 to 24 carbon atoms and an insoluble metal salt of an alkyl phosphate. The metal is a metal other than an alkali metal, and there can be mentioned aluminum, calcium, magnesium and zinc. Magnesium is especially preferred. The insoluble metal salt of the alkyl phosphate can be prepared by reacting the phosphoric acid ester represented by the above-mentioned formula (I) or (II) with a metal salt represented by the following general formula (III):

$$M_mX_n \quad \text{(III)}$$

wherein M stands for a metal other than an alkali metal, X stands for an organic or inorganic anion, and m and n stand for an integer.

In the general formula (III), M stands for a metal other than an alkali metal, and aluminum, calcium, magnesium and zinc are preferred for the cleanser. As the inorganic anion X, there can be mentioned OH, a halogen, $SO_4$, $NO_2$, $CO_3$ and $PO_4$, and as the organic anion, there can be mentioned an organic carboxylic acid. Compounds of the general formulae (I) and (II) wherein X and Y stand for arginine or morpholine may be used as the alkyl phosphate.

Various insoluble metal salts of alkyl phosphates differing in the structure can be used as the component (B) in the present invention.

As the metal salt of the alkyl phosphate that can be prepared according to the above-mentioned process, there can be mentioned compounds represented by the following general formulae (IV) through (IX):

(IV)

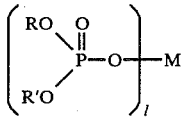

(V)

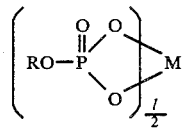

(VI)

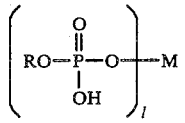

(VII)

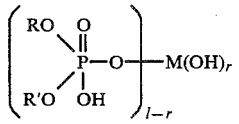

-continued (VIII)

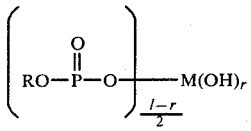

and (IX)

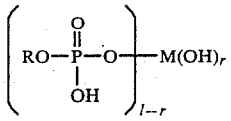

wherein R and R′ stand for an alkyl group having 8 to 18 carbon atoms, M stands for a metal other than an alkali metal, l is an integer corresponding to the valency of M, and r is an integer larger than 0 but smaller than l−1.

The insoluble metal salt (B) of the surface active agent may be incorporated into the composition or may be prepared by reacting the surface active agent with a metal salt during the preparation process according to customary procedures. One insoluble salt (B) or a mixture of two or more of insoluble salts (B) may be used. When a super-fatting agent is not used, it is preferred that the weight ratio of the component (A) to the component (B) be in the range of from 10/0.05 to 10/10, especially from 10/0.2 to 10/8.

As the super-fatting agent used as the component (C) in the present invention, there can be mentioned a higher fatty acid having 8 to 24 carbon atoms, a mixture of such higher fatty acids, a higher alcohol having 8 to 24 carbon atoms, a mixture of such higher alcohols, a hydrocarbon, an ester, a glycol, lecithin, a derivative thereof, lanolin, a derivative thereof, a phosphoric acid ester of the general formula (I) or (II) where both of X and Y stand for a hydrogen atom, a derivative thereof, and other known super-fatting agents. When the component (C) is incorporated, the component (A)/component (B)/component (C) weight ratio is in the range of from 10/0.001/0.01 to 10/10/10, preferably from 10/0.05/0.2 to 10/8/5. When a super-fatting agent capable of forming a salt, such as a higher fatty acid, is used, the effect of the present invention is not inhibited, even if the super-fatting agent is partially converted to form a salt of a higher fatty acid by salt-exchange reaction with the phosphoric acid ester salt.

In view of the bubbling property and skin-irritating property, the pH value of the cleanser composition of the present invention (in the form of a 5% aqueous solution) be 5.5 to 8.5.

In the present invention, if the insoluble metal salt of the surface active agent is incorporated in the phosphoric acid ester salt, the object of the present invention can be tentatively attained, but if the super-fatting agent is further incorporated in the composition, a cleanser composition having a very excellent quality can be obtained. This effect is especially high when the amount incorporated of the insoluble metal salt of the surface active agent is small.

Solvents such as water, colorants, perfumes, fungicides, antiinflammatory agents, chelating agents, inorganic or organic salts, viscosity modifiers, bubbling agents, antiseptic agents, wetting agents and other surface active agents may be incorporated in the cleanser composition of the present invention in addition to the above-mentioned essential components according to the form and intended use of the composition, so far as attainment of the effect of the present invention is not inhibited.

The cleanser composition of the present invention may be prepared by mixing the above components according to a known method, and the shape is not particularly critical and any of solid, liquid, powdery, granular and pasty forms may be adopted.

The cleanser composition of the present invention is very mild to the skin and hairs and the composition shows a good bubbling property and gives fine bubbles.

EXAMPLES

The present invention will now be described in detail with reference to the following examples that by no means limit the scope of the invention.

EXAMPLE 1

A phosphoric acid ester salt was mixed with an insoluble metal salt of a surface active agent at a mixing ratio shown in Table 1. The unit of each number shown in Table 1 is "parts by weight".

The bubbling quantity of the cleanser composition was measured by the mechanical method. Furthermore, with respect to the bubbling quantity and the bubble creaminess, the hand washing test was carried out by a panel consisting of 10 experts. The obtained results are shown in Table 2.

The mechanical measurement of the bubbling quantity was carried out in the following manner. The cleanser composition was formed into an aqueous solution having an surfactant concentration of 5% (the total concentration of sodium monolauryl phosphate and sodium monomyristyl phosphate), and 100 g of the solution was charged in a graduated cylinder. Then, a stirring vane was set in the solution, and the volume of bubbles generated when stirring was conducted for 30 seconds was measured. The rotation number of the stirring vane was 1000 rpm and the stirring direction was reversed every 5 seconds.

Evaluation Standard at Water Washing Organoleptic Test

5: very excellent
4: excellent
3: common
2: inferior
1: very inferior

TABLE 1

| | Products of Present Invention | | | | | | | | | | | |
|---|---|---|---|---|---|---|---|---|---|---|---|---|
| | 1 | 2 | 3 | 4 | 5 | 6 | 7 | 8 | 9 | 10 | 11 | 12 |
| sodium monolauryl phosphate | 100 | 100 | 100 | 100 | 100 | 100 | 100 | 100 | 100 | 50 | 100 | 100 |
| sodium monomyristyl phosphate | | | | | | | | | | 50 | | |
| sodium oxyethylene (3) monomyristyl phosphate* | | | | | | | | | | | | |
| calcium monolauryl phosphate | 40 | | | | | | | | | | | |
| magnesium monolauryl phosphate | | 40 | | | | | | | | | 1 | 5 |
| zinc monolauryl phosphate | | | 40 | | | | | | | | | |
| calcium laurate | | | | 40 | | | | | | 40 | | |
| magnesium laurate | | | | | 40 | | | | | | | |
| zinc laurate | | | | | | 40 | | | | | | |
| calcium stearate | | | | | | | 40 | | | | | |
| magnesium stearate | | | | | | | | 40 | | | | |
| zin stearate | | | | | | | | | 40 | | | |
| water | 20 | 20 | 20 | 20 | 20 | 20 | 20 | 20 | 20 | 20 | 20 | 20 |

| | Products of Present Invention | | | | | | | | Comparative Products | | | |
|---|---|---|---|---|---|---|---|---|---|---|---|---|
| | 13 | 14 | 15 | 16 | 17 | 18 | 19 | 20 | 21 | 22 | 23 | 24 |
| sodium monolauryl phosphate | 100 | 100 | 100 | 50 | | | | | 50 | 100 | 100 | |
| sodium monomyristyl phosphate | | | | 50 | | | | | 50 | | | |
| sodium oxyethylene (3) monomyristyl phosphate* | | | | | 100 | 100 | 100 | 100 | | | | 100 |
| calcium monolauryl phosphate | | | | 40 | 1 | 20 | 90 | | | | | |
| magnesium monolauryl phosphate | 20 | 60 | 90 | | | | | | | | 110 | |
| zinc monolauryl phosphate | | | | | | | | | | | | |
| calcium laurate | | | | | | | | 10 | | | | |
| magnesium laurate | | | | | | | | | | | | |
| zinc laurate | | | | | | | | | | | | |
| calcium stearate | | | | | | | | | | | | |
| magnesium stearate | | | | | | | | | | | | |
| zin stearate | | | | | | | | | | | | |
| water | 20 | 20 | 25 | 20 | 20 | 20 | 20 | 20 | 15 | 15 | 30 | 15 |

Note
*parenthesized value indicates the number of moles of added oxyethylene units

TABLE 2

| | | Bubbling Quantity (ml) at 40° C. | Hand Washing Organoleptic Test | |
|---|---|---|---|---|
| | | | Bubbling Quantity | Bubble Creaminess |
| Products of Present Invention | 1 | 298 | 3.7 | 4.2 |
| | 2 | 332 | 4.5 | 4.2 |
| | 3 | 280 | 3.5 | 3.7 |
| | 4 | 320 | 4.3 | 4.4 |
| | 5 | 335 | 4.6 | 4.5 |
| | 6 | 328 | 4.5 | 4.2 |
| | 7 | 283 | 3.6 | 3.8 |
| | 8 | 299 | 3.9 | 4.0 |
| | 9 | 285 | 3.6 | 3.7 |
| | 10 | 293 | 3.7 | 3.9 |
| | 11 | 292 | 3.7 | 3.9 |
| | 12 | 320 | 4.4 | 4.3 |
| | 13 | 325 | 4.6 | 4.5 |
| | 14 | 336 | 4.6 | 4.5 |
| | 15 | 287 | 3.6 | 4.6 |
| | 16 | 295 | 3.8 | 4.5 |
| | 17 | 280 | 3.5 | 3.5 |
| | 18 | 300 | 3.8 | 3.7 |
| | 19 | 285 | 3.6 | 3.5 |
| | 20 | 290 | 3.7 | 3.6 |
| Comparative Products | 21 | 236 | 2.6 | 2.8 |
| | 22 | 251 | 2.8 | 2.7 |
| | 23 | 210 | 1.9 | 3.8 |
| | 24 | 207 | 2.6 | 2.4 |

As is apparent from the results shown in Table 2, the product of the present invention formed by incorporating a higher fatty acid metal salt or phosphoric acid ester metal salt into a phosphoric acid ester salt is excellent over a comparative product comprising a phosphoric acid ester salt alone because the mechanical bubbling quantity is significantly larger and the bubbling quantity and bubble creaminess at the organoleptic test are better.

EXAMPLE 2 (SOLID CEANSER)

A cleanser composition shown in Table 3 was prepared to check the bubbling property in the same manner as described in Example 1 and examine the effect attained by addition of a super-fatting agent. The obtained results are shown in Table 4. Incidentally, in Table 3, the unit of each numerical value is "% by weight".

TABLE 3

| | Products of Present Invention | | | | | | | | | | | |
|---|---|---|---|---|---|---|---|---|---|---|---|---|
| | 1 | 2 | 3 | 4 | 5 | 6 | 7 | 8 | 9 | 10 | 11 | 12 |
| sodium monolauryl phosphate | 100 | 100 | 100 | 100 | 100 | 100 | 100 | 100 | 100 | 50 | 100 | 100 |
| sodium monomyristyl phosphate | | | | | | | | | | 50 | | |
| sodium oxyethylene (3) monomyristyl phosphate | | | | | | | | | | | | |
| magnesium monolauryl phosphate | 0.3 | | 0.3 | 0.3 | 0.3 | 0.3 | | | | 0.3 | 40 | |
| magnesium laurate | | 0.3 | | | | | 1.0 | 1.0 | 1.0 | | | 40 |
| lauric acid | 5 | 5 | | | | 50 | 15 | 50 | 100 | 5 | 5 | 5 |
| stearic acid | | | 5 | | | | | | | | | |
| coconut oil fatty acid | | | | 5 | | | | | | | | |
| lauryl alcohol | | | | | 5 | | | | | | | |
| water | 15 | 15 | 15 | 15 | 15 | 15 | 15 | 15 | 15 | 15 | 20 | 20 |

| | Products of Present Invention | | | | | | | Comparative Products | | | |
|---|---|---|---|---|---|---|---|---|---|---|---|
| | 13 | 14 | 15 | 16 | 17 | 18 | 19 | 20 | 21 | 22 | 23 |
| sodium monolauryl phosphate | 50 | | | | | | | 100 | 100 | 50 | 100 |
| sodium monomyristyl phosphate | 50 | | | | | | | | | 50 | |
| sodium oxyethylene (3) monomyristyl phosphate | | 100 | 100 | 100 | 100 | 100 | 100 | 100 | | | |
| magnesium monolauryl phosphate | 40 | 0.3 | 0.3 | | | 0.3 | | 0.3 | | 0.3 | 110 |
| magnesium laurate | | | | 0.3 | 0.3 | | 0.3 | | 0.3 | | |
| lauric acid | 5 | 5 | | 5 | | | | | | | 110 |
| stearic acid | | | 5 | | 5 | | | | | | |
| coconut oil fatty acid | | | | | | | | | | | |
| lauryl alcohol | | | | | | | | | | | |
| water | 20 | 15 | 15 | 15 | 15 | 20 | 20 | 15 | 15 | 15 | 45 |

Note
*parenthesized value indicates the number of added oxyethylene units

TABLE 4

| | | Bubbling Quantity (ml) at 40° C. | Hand Washing Organoleptic Test | |
|---|---|---|---|---|
| | | | Bubbling Quantity | Bubble Creaminess |
| Products of Present Invention | 1 | 298 | 3.9 | 3.8 |
| | 2 | 300 | 4.0 | 4.0 |
| | 3 | 276 | 3.4 | 3.7 |
| | 4 | 285 | 3.6 | 3.9 |
| | 5 | 272 | 3.3 | 4.0 |
| | 6 | 310 | 4.0 | 4.4 |
| | 7 | 305 | 4.0 | 4.3 |
| | 8 | 318 | 4.2 | 4.5 |
| | 9 | 330 | 4.5 | 4.7 |
| | 10 | 282 | 3.5 | 4.0 |
| | 11 | 351 | 4.8 | 4.9 |
| | 12 | 350 | 4.8 | 4.7 |
| | 13 | 336 | 4.5 | 4.3 |
| | 14 | 288 | 3.7 | 3.7 |
| | 15 | 280 | 3.6 | 3.6 |
| | 16 | 291 | 3.7 | 3.7 |
| | 17 | 282 | 3.5 | 3.5 |
| | 18 | 260 | 3.7 | 3.7 |
| | 19 | 268 | 3.4 | 3.4 |
| Comparative Products | 20 | 253 | 2.8 | 3.2 |
| | 21 | 257 | 2.9 | 3.4 |
| | 22 | 247 | 2.7 | 3.7 |
| | 23 | 213 | 2.0 | 4.0 |

From the results shown in Table 4, it is seen that the product of the present invention formed by incorporating an insoluble metal salt and a super-fatting agent into a phosphoric acid ester salt is excellent over the comparative product composed solely of a phosphoric acid ester salt alone in the bubbling property and the state of bubbles and is better than the product of Example 1 formed by incorporating only an insoluble metal salt in a phosphoric acid ester salt in the bubbling quantity and the bubble creaminess. The effect is especially high in the composition in which the amount incorporated of the insoluble metal salt is small.

EXAMPLE 3 (SOLID CLEANSER)

Sodium monolauryl phosphate: 45%
Sodium monomyristyl phosphate: 15%
Lauric acid: 8%
Stearic acid: 7%
Calcium laurate: 7%
Magnesium monolauryl phosphate: 6%
Water: 12%

A solid cleanser having the above composition was prepared and subjected to the hand washing organoleptic test in the same manner as described in Example 1. The bubbling property was good and the bubbles were fine and had an agreeable touch.

EXAMPLE 4 (SOLID CLEANSER)

Sodium monomyristyl phosphate: 55%
Sodium monolauryl phosphate: 15%
Sodium polyoxyethylene (10) monomyristyl phosphate: 5%
Zinc stearate: 4%
Calcium laurate: 4%
Zinc monolauryl phosphate: 5%
Water: 12%

A solid cleanser having the above composition was prepared and subjected to the hand washing organoleptic test in the same manner as described in Example 1. The bubbling property was good and the bubbles were fine and had an agreeable touch.

EXAMPLE 5 (BODY SHAMPOO)

Potassium monomyristyl phosphate: 5%
Triethanolamine monomyristyl phosphate: 10%
Potassium monolauryl phosphate: 5%
Triethanolamine monolauryl phosphate: 10%
Calcium myristate: 2%
Lauric acid: 5%
Glycerol: 10%
Ethanol: 5%
Propylene glycol: 5%
Perfume, antiseptic and colorant: appropriate amounts
Water: balance From the above components was prepared a creamy body shampoo having a good bubbling property.

EXAMPLE 6 (CLEANSING CREAM)

Potassium monomyristyl phosphate: 25%
Potassium monolauryl phosphate: 15%
Zinc stearate: 1%
Propylene glycol: 10%
Sodium chloride: 8%
Sorbitol: 2%
Glycerol: 10%
Perfume, colorant and antiseptic: appropriate amounts
Water (pH value=7.3): balance From the above components was prepared a cleansing cream having a good bubbling property and creamy bubbles.

The embodiments of the invention in which an exclusive property or privilege is claimed are defined as follows:

1. A detergent composition which comprises (A) 10 parts by weight of a phosphoric acid ester of the formula (I) or (II):

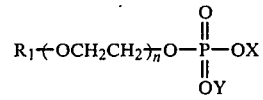

(I)

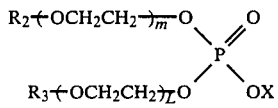

(II)

in which $R_1$, $R_2$ and $R_3$ each are a saturated or unsaturated hydrocarbon group having 8 to 18 carbon atoms, X and Y each are hydrogen, an alkali metal, ammonium or an alkanolamine having 2 or 3 carbon atoms and n, m and L each are zero or an integer of 1 to 10, (B) 0.001 to 10 parts by weight of a water-insoluble metal salt of a surface active agent, with the proviso that said metal is not an alkali metal, and (C) 0.01 to 10 parts by weight of a superfatting agent selected from the group consisting of higher fatty acids having 8 to 24 carbon atoms and mixtures thereof, higher alcohols having 8 to 24 carbon atoms and mixtures thereof, hydrocarbons, propylene glycol lecithin, derivatives of lecithin, lanolin and derivatives of lanolin.

2. A detergent composition as claimed in claim 1, in which said insoluble metal salt of the surface active agent is a salt of a higher fatty acid or an alkyl phosphate.

3. A detergent composition as claimed in claim 1, in which said metal is aluminum, calcium, magnesium or zinc.

4. A detergent composition as claimed in claim 1, which comprises 5 to 95 percent by weight of component (A).

5. An aqueous solution of the compositon as claimed in claim 1, having a pH of 5.5 to 8.5 when it has a concentration of 5 percent by weight.

6. A detergent composition as claimed in claim 1, which is in the form of solid, liquid, powder, granules or paste.

7. A detergent composition as claimed in claim 1, in which said super-fatting agent is selected from the group consisting of higher fatty acids having 8 to 24 carbon atoms, mixtures thereof, higher alcohols having 8 to 24 carbon atoms and mixtures thereof.

8. A detergent composition as claimed in claim 1, in which component (A) consists essentially of a phosphoric acid ester having the formula (I) and up to 50 percent by weight, based on the total weight of component (A), of a phosphoric acid ester having the formula (II).

9. A detergent composition as claimed in claim 1 in which the weight ratio of (A)/(B)/(C) is from 10/0.05/0.2 to 10/8/5.

10. A detergent composition as claimed in claim 1 in which (A) is selected from the group consisting of sodium monolauryl phosphate, sodium monomyristyl phosphate, sodium oxyethylene (3) monomyristyl phosphate, sodium oxyethylene (10) monomyristyl phosphate, potassium monomyristyl phosphate, triethanolamine monomyristyl phosphate, potassium monolauryl phosphate and triethanolamine monolauryl phosphate, (B) is selected from the group consisting of calcium monolauryl phosphate, magnesium monolauryl phosphate, zinc monolauryl phosphate, calcium myristate, calcium laurate, magnesium laurate, zinc laurate, calcium stearate, magnesium stearate and zinc stearate, and (C) is selected from the group consisting of lauric acid, stearic acid, coconut oil fatty acid and lauryl alcohol.

11. A detergent composition as claimed in claim 1, which contains glycerol.

* * * * *